US009127498B1

(12) United States Patent
Ye

(10) Patent No.: US 9,127,498 B1
(45) Date of Patent: Sep. 8, 2015

(54) INSULATING WINDOW FRAME

(71) Applicant: Jintian Ye, Duarte, CA (US)

(72) Inventor: Jintian Ye, Duarte, CA (US)

( * ) Notice: Subject to any disclaimer, the term of this patent is extended or adjusted under 35 U.S.C. 154(b) by 0 days.

(21) Appl. No.: 14/201,181

(22) Filed: Mar. 7, 2014

(51) Int. Cl.
*E06B 3/263* (2006.01)
*E06B 3/24* (2006.01)

(52) U.S. Cl.
CPC ..... *E06B 3/26341* (2013.01); *E06B 3/24* (2013.01)

(58) Field of Classification Search
CPC ..... E06B 3/64; E06B 3/645; E06B 3/5454; E06B 3/62; E06B 3/5427; E06B 3/24; E06B 3/66366; E06B 3/66347; E06B 2003/6267; E06B 2003/5472; E06B 3/26341
USPC ..... 52/204.595, 204.597, 204.6, 204.62, 52/204.71, 204.72, 204.55, 214, 786.1, 52/786.13, 792.1, 792.11, 656.1, 656.2, 52/656.7; 49/501, DIG. 1
See application file for complete search history.

(56) References Cited

U.S. PATENT DOCUMENTS

| | | | | | |
|---|---|---|---|---|---|
| 3,024,881 | A * | 3/1962 | Haas | 52/204.593 |
| 3,229,434 | A * | 1/1966 | Baker | 52/204.597 |
| 3,442,059 | A * | 5/1969 | Kessler | 52/204.595 |
| 3,992,843 | A * | 11/1976 | DiFazio | 52/204.593 |
| 4,121,394 | A * | 10/1978 | Brooks | 52/203 |
| 4,409,769 | A * | 10/1983 | Redman | 52/211 |
| 4,483,099 | A * | 11/1984 | Schmidt | 49/63 |
| 4,494,342 | A * | 1/1985 | Decker | 52/203 |
| 4,581,852 | A * | 4/1986 | Jager et al. | 49/501 |
| 4,694,552 | A * | 9/1987 | Ecker et al. | 29/418 |
| 4,753,056 | A * | 6/1988 | Pacca | 52/204.593 |
| 4,793,107 | A * | 12/1988 | Pacca | 52/204.51 |
| 4,996,814 | A * | 3/1991 | Guillemet | 52/656.5 |
| 5,430,981 | A * | 7/1995 | Scott | 52/202 |
| 5,622,017 | A * | 4/1997 | Lynn et al. | 52/209 |
| 5,709,055 | A * | 1/1998 | Levi | 52/204.5 |
| 5,887,391 | A * | 3/1999 | Shoup | 52/202 |
| 7,694,472 | B2 * | 4/2010 | Rawlings | 52/210 |
| 7,765,751 | B2 * | 8/2010 | Vukovic et al. | 52/204.595 |
| 2004/0003553 | A1 * | 1/2004 | Donoghue | 52/204.5 |
| 2007/0028539 | A1 * | 2/2007 | Peabody et al. | 52/204.55 |
| 2008/0245000 | A1 * | 10/2008 | Lambertini | 52/204.1 |
| 2008/0245027 | A1 * | 10/2008 | Lambertini | 52/717.02 |
| 2009/0139163 | A1 * | 6/2009 | Prete et al. | 52/204.593 |
| 2009/0139164 | A1 * | 6/2009 | Prete et al. | 52/204.593 |
| 2009/0139165 | A1 * | 6/2009 | Prete et al. | 52/204.593 |
| 2009/0313941 | A1 * | 12/2009 | Siodla | 52/800.13 |
| 2010/0115877 | A1 * | 5/2010 | Yoo et al. | 52/656.2 |
| 2010/0281797 | A1 * | 11/2010 | Yun | 52/209 |
| 2010/0293881 | A1 * | 11/2010 | Betz et al. | 52/656.2 |
| 2012/0141699 | A1 * | 6/2012 | Mader | 428/34 |
| 2012/0297707 | A1 * | 11/2012 | Lenz et al. | 52/204.593 |

* cited by examiner

*Primary Examiner* — James Ference
(74) *Attorney, Agent, or Firm* — Clement Cheng

(57) ABSTRACT

An insulated window frame has a frame having at least an internal frame. The internal frame includes an inside trim adapter receiver formed on an inside surface of the internal frame; an intermediate trim adapter receiver formed on the inside surface of the internal frame; an internal frame central flange extending from the internal frame, an inside trim adapter configured to fit to the inside trim adapter receiver; an outside glass panel; and an inside glass panel. The internal frame central flange retains an outside glass panel. The frame has an internal frame outer structure and an internal frame inner structure. A thermal break is preferably installed between the internal frame outer structure and the internal frame inner structure. An intermediate trim adapter can connect to an intermediate trim adapter receiver.

18 Claims, 3 Drawing Sheets

INSULATING WINDOW FRAME

FIELD OF THE INVENTION

The present invention is in the field of insulating window frames.

DISCUSSION OF RELATED ART

A variety of different windows allows removal of a single window pane and replacement with a different window pane. Traditional wood construction provides a variety of different possible configurations.

SUMMARY OF THE INVENTION

An insulated window frame has a frame having at least an internal frame, an outside glass panel and an inside glass panel. The internal frame includes: an inside trim adapter receiver formed on an inside surface of the internal frame; an intermediate trim adapter receiver formed on the inside surface of the internal frame; an internal frame central flange extending from the internal frame, an inside trim adapter configured to fit to the inside trim adapter receiver. The internal frame central flange retains an edge of the outside glass panel. The frame has an internal frame outer structure and an internal frame inner structure. A thermal break is preferably installed between the internal frame outer structure and the internal frame inner structure. An intermediate trim adapter can connect to an intermediate trim adapter receiver.

The outside glass panel is mounted between the intermediate trim adapter and the internal frame central flange. The inside glass panel is mounted between the intermediate trim adapter and an inside trim adapter. An outside trim adapter can connect to an outside trim adapter receiver so that the outside trim adapter forms the internal frame central flange. The outside glass panel can be attached to the inside glass panel by an air seal spacer to form an insulated glass panel. The window is configurable so that the intermediate trim adapter receiver may remain empty and not hold an intermediate trim adapter. The internal frame central flange has a trim seal mounting slot. A trim seal is mounted in the trim seal mounting slot. The intermediate trim adapter receiver is formed as a groove or slot. The intermediate trim adapter may have a pair of engagement edges that engage to the intermediate trim adapter receiver. The inside trim adapter receiver is formed as a groove or slot, and the inside trim adapter has a pair of engagement edges that engage to the inside trim adapter receiver. A screen frame is mounted within a screen frame slot. The screen frame slot is formed on the frame. The frame may also have a peripheral frame, with the internal frame fitting within the peripheral frame, and the internal frame is attached to the peripheral frame.

The following call out list of elements can be a useful guide in referencing the elements of the drawings.

10 Window
20 Peripheral Frame
21 Peripheral Frame Outer Structure
22 Peripheral Frame Outside Connector Channel
23 Peripheral Frame Outside Channel
24 Peripheral Frame Outside Exposed Surface
25 Peripheral Frame Inner Structure
26 Peripheral Frame Inside Connector Channel
27 Peripheral Frame Inside Seal
28 Screen Frame
29 Screen Channel
31 Peripheral Frame Inside Channel
32 Peripheral Frame Inside Upper Slot
33 Peripheral Frame Inside Lower Slot
34 Peripheral Frame Outside Upper Slot
35 Peripheral Frame Outside Lower Slot
36 Peripheral Frame Inside Vertical Surface
37 Screen Frame Channel
38 Peripheral Frame Inside Trim Seal
39 Peripheral Frame Inside Trim Seal Flexible Extension
40 Internal Frame Outer Structure
41 Internal Frame Distal Flange
42 Internal Frame Central Flange
43 First Trim Seal Mounting Slot
44 Second Trim Seal Mounting Slot
45 First Distal Trim Seal Mounting Slot
46 Second Distal Trim Seal Mounting Slot
48 Trim Seal
49 Internal Frame Middle Channel Vertical Portion
50 Internal Frame Inner Structure
51 Outside Thermal Break Connector
52 Inside Thermal Break Connector
53 Inside Trim Adapter Receiving Slot
54 Intermediate Trim Adapter Receiving Grooves
55 Outside Trim Adapter Receiving Groove
56 Internal Frame Inside Channel
57 Internal Frame Middle Channel
58 Internal Frame Outside Channel
59 Internal Frame Lower Slot
60 Adapter Structure
61 Thin Glass Inside Trim Adapter
62 Intermediate Trim Adapter
63 Thick Glass Inside Trim Adapter
64 Outside Trim Adapter
65 Inside Glazing Bead
66 Intermediate Inside Glazing Bead
67 Intermediate Outside Glazing Bead
68 Inside Trim Adapter Primary Section
69 Inside Trim Adapter Secondary Section
71 Intermediate Trim Adapter Outside Protrusion
72 Intermediate Trim Adapter Inside Protrusion
73 Outside Trim Adapter Inside Protrusion
74 Outside Trim Adapter Outside Protrusion
75 Inside Trim Adapter Extension
76 Intermediate Trim Adapter First Leg
77 Intermediate Trim Adapter First Leg Horizontal Section
78 Intermediate Trim Adapter Second Leg
79 Thin Glass Inside Trim Adapter Legs
80 Glass Panel
81 First Outside Glass Panel
82 Second Outside Glass Panel
83 Air Seal Spacer
84 Air Seal Spacer Channel
85 First Inside Glass Panel
86 Second Inside Glass Panel
87 Inside Polymer Laminate Layer
88 Second Outside Glass Panel Polymer Laminate Layer
89 Second Outside Glass Panel Laminate Pane
90 Thermal Break Extrusion Means
91 Peripheral Frame First Thermal Break

92 Peripheral Frame Second Thermal Break
93 Internal Frame First Thermal Break
94 Internal Frame Second Thermal Break
95 Argon Filled Gas

DETAILED DESCRIPTION OF THE PREFERRED EMBODIMENT

Figure 1:
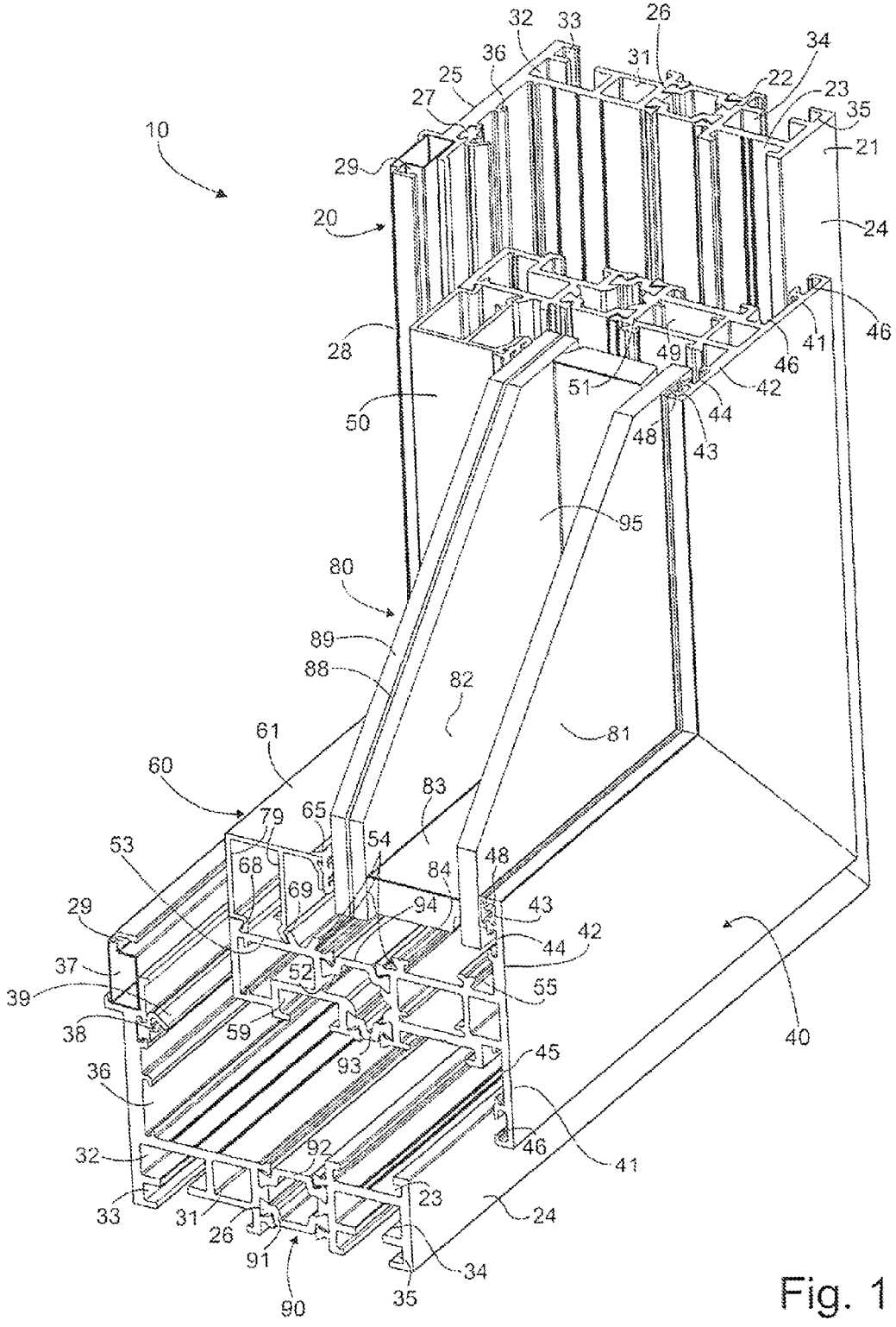
FIG. 1 is a cross section diagram showing construction of a two pane glass window.
Figure 2:
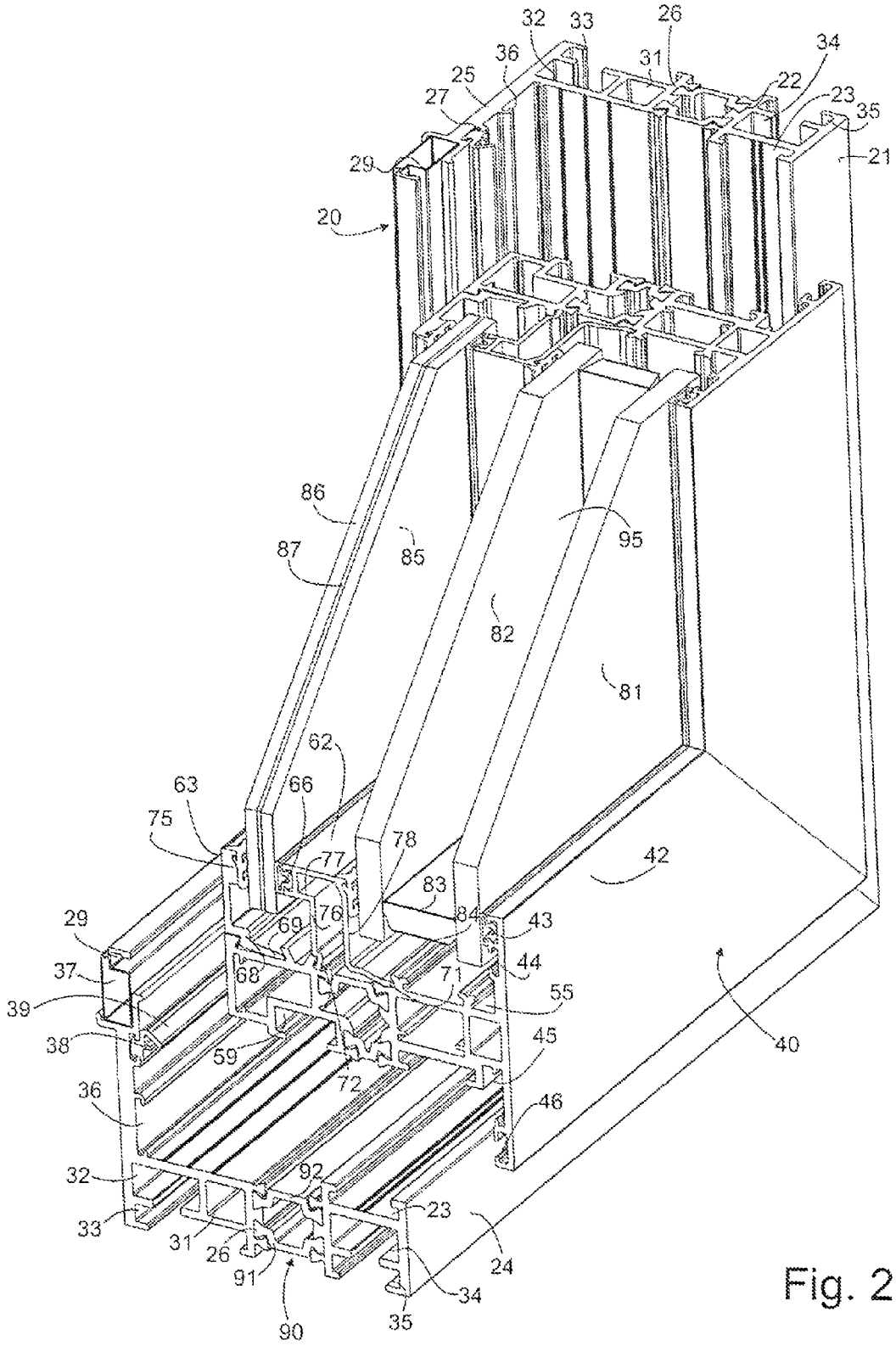
FIG. 2 is a cross section diagram showing construction of a three pane glass window.
Figure 3:
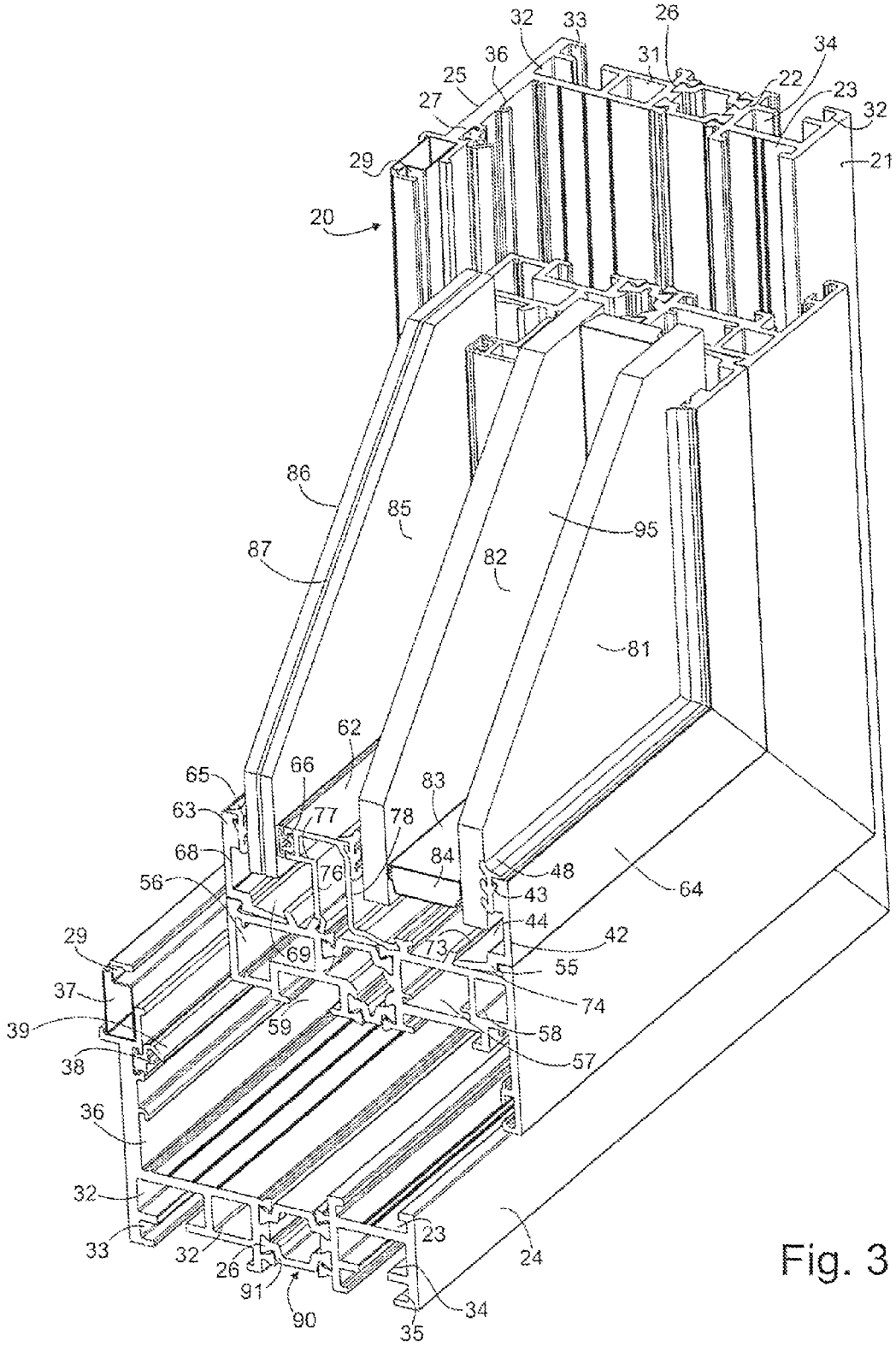
FIG. 3 is a cross section diagram showing construction of a three pane glass window.

The best mode and preferred embodiment is seen in FIGS. 1-3, where the glass window 10 is reconfigurable into multiple configurations that the glass window can switch between. The cross-section figures show assembly of the glass window 10, rather than the final product. The final product is a completely assembled window that from the exterior looks similar to traditional vinyl or aluminum windows. The reconfigurable glass window allows for flexibility in configuration. The frame of the glass window is extruded and can be extruded in a polymer such as vinyl or a metal such as aluminum. Different portions of the frame can be made of different materials, or the same material.

Generally, the window has a peripheral frame 20 that is held within an internal frame outer structure 40 and an internal frame inner structure 50. An adapter structure 60 holds a series of glass panels 80. A thermal break extrusion means 90 connects the internal frame outer structure to the internal frame inner structure, and also connects the peripheral frame outer structure 21 to the peripheral frame inner structure 25. The key to the invention is the use of an adapter structure 60 that provides modular connection of various trim adapters to various grooves on the internal frame. A variety of different trim adapters can be installed on a variety of different trim adapter receivers. An inside trim adapter receiver can receive an inside trim adapter. An intermediate trim adapter receiver can receive an intermediate trim adapter. Also, an outside trim adapter receiver can receive an outside trim adapter. The trim adapter receivers can be formed as channels, grooves or slots and the trim adapters can be formed as extrusions having legs that have edges that press fit engage into the trim adapter receivers. The trim adapter receivers could also be made as protrusions that fit into channels, grooves or slots on the trim adapters. Grooves and slots should be considered to be equivalent language with a groove and slot being equivalent. The channel is an enclosed portion of an extrusion.

The peripheral frame has a peripheral frame outside connector channel 22 and a peripheral frame inside connector channel 26 that cooperate to hold a peripheral frame thermal break. The peripheral frame thermal break can be formed as a peripheral frame first thermal break 91 and a peripheral frame second thermal break 92. The first and second peripheral frame thermal break can be made of a composite such as fiberglass, or printed circuit board material, with or without circuit trace. The peripheral frame first thermal break 91 and the peripheral frame second thermal break 92 can be made parallel to each other formed as planks having protruding edges that lodge within the peripheral frame inside connector channel 26 and the peripheral frame outside connector channel 22. The channels are preferably shaped to receive the trapezoid profile of the thermal break. The thermal break members are preferably made of material that has low thermal conductivity such as nonmetallic materials.

The peripheral frame may also have a peripheral frame outside channel 23. The peripheral frame outside channel 23 can be connected to a variety of other structures. The peripheral frame outside channel 23 may have a peripheral frame outside lower slot 35 for adapting to other structures. The peripheral frame outside channel 23 terminates in a peripheral frame outside exposed surface 24. The peripheral frame outside exposed surface 24 is formed as a flange that extends away orthogonally from the peripheral frame. The peripheral frame outside exposed surface 24 is preferably formed perpendicularly to the plane of the first thermal break 91 and the second thermal break 92. The thermal break material can be a laminate construction of thermal low conductivity structural insulation layers.

The peripheral frame also has a peripheral frame inside seal 27. The peripheral frame inside seal 27 is lodged within a slot formed on the peripheral frame inner structure 25. The peripheral frame inside seal 27 has a peripheral frame inside trim seal 38 and a peripheral frame inside trim seal flexible extension 39. The peripheral frame inside trim seal flexible extension 39 pushes against and forms a seal between the peripheral frame inner structure 25 and the internal frame inner structure 50. The peripheral frame inside trim seal flexible extension 39 could abut the adapter structure 60, such as at the thin glass inside trim adapter 61 or could abut a different portion of the internal frame inner structure 50.

A screen frame 28 is mounted on a screen frame slot. The screen frame slot is formed on the peripheral frame inner structure 25. The screen frame 28 generally has a screen frame channel 37 forming a hollow tubular structure that supports a screen channel 29. A mesh screen for allowing air flow by filtering out debris and insects can be mounted on the screen channel 29 by interference fit of the mesh screen to the screen channel 29 using an elongated elastomeric coupler. An elongated elastomeric coupler can be pressed into the screen channel 29 to retain a screen to the screen frame 28.

The peripheral frame has a peripheral frame inside channel 31. The peripheral frame inside channel is an elongated structure that provides rigidity to the peripheral frame. The peripheral frame also has a peripheral frame inside upper slot 32. The peripheral frame inside upper slot 32 can be used for connecting the peripheral frame to other structures. Similarly, the peripheral frame inside lower slot 33 can be used to connect the peripheral frame to other structures. Other structures may include other frames, or mechanisms such as rollers and slides. The peripheral frame also has a peripheral frame outside upper slot 34 which may allow a thermal break or other connector to connect between the peripheral frame and the internal frame. The peripheral frame outside upper slot 34 could be used for connecting to a respective slot on the internal frame.

The peripheral frame inside vertical surface 36 extends inwardly to form a flange. The peripheral frame inside seal 27 can be mounted on a slot formed on the peripheral frame inside vertical surface 36. The peripheral frame inside vertical surface 36 can have other sealing and sliding structure is attached to it such as wheels, brushes, slides or like interfacing, connecting hardware.

The internal frame has an internal frame distal flange 41 that protrudes away from the internal frame. The internal frame also has an internal frame central flange 42 that protrudes inward from the internal frame. The internal frame distal flange 41 is parallel to the internal frame central flange 42 but perpendicular to the remainder of the internal frame. The internal frame central flange 42 has a first trim seal mounting slot 43 to allow a trim seal to be mounted to the inside surface of the central flange 42. The trim seal 48 can be an elastomeric seal member that maintains a contact between the internal frame central flange 42 and the first outside glass panel 81. A first trim seal mounting slot 43 could have a first trim seal 48, and a second trim seal mounting slot 44 can be formed adjacent to the first trim seal mounting slot 43 on the inside surface of the internal frame central flange 42. The second trim seal mounting slot 44 can be made of the same size as the first trim seal mounting slot 43. A user may desire to use the first trim seal mounting slot 43 and also optionally the second trim seal mounting slot 44. A first distal trim seal mounting slot 45 can be formed on an inside surface of the internal frame distal flange 41. The first distal trim seal mounting slot 45 can have a second distal trim seal mounting slot 46 formed adjacent to provide different mounting options for mounting various trim seals between the internal frame and the peripheral frame. The various trim seals are preferably elastomeric, but can also be brush bristle based.

The internal frame preferably has an internal frame middle channel vertical portion 49 to provide greater structural rigidity to the internal frame. Adjacent to the internal frame middle channel vertical portion 49 is an outside thermal break connector 51 and an inside thermal break connector 52. An internal frame first thermal break 93 and an internal frame second thermal break 94 connect between the outside thermal break connector 51 and the inside thermal break connector 52. The outside thermal break connector 51 and the inside thermal break connector 52 can be formed as one or more slots for receiving the internal frame first thermal break 93 and the internal frame second thermal break 94.

The basic structure as noted above provides a frame structure allowing mounting of glass to the structure. A variety of different adapters can provide modularly varying options for mounting different types of glass to the frame structure. While most windows are suited for only one dimension and configuration of glass mounting, the present invention seeks to provide options for the user. The adapters are preferably mounted on receiving slots. For example, the inside trim adapter is preferably mounted on an inside trim adapter receiving slot 53. The inside trim adapter can be formed as a thin glass inside trim adapter 61, or a thick glass inside trim adapter 63. The thin glass inside trim adapter 61 has a different thickness that is greater than the thick glass inside trim adapter 63. The trim adapters can be aluminum or vinyl extrusions. A thick glass inside trim adapter 63 can receive an inside glazing bead 65 that is mounted to an inside glazing bead slot extruded along the length of the thick glass inside trim adapter 63. The inside trim adapter also has an inside trim adapter extension 75 that provides a support for the inside glazing bead 65.

An intermediate trim adapter 62 can partition an outside glass panel from an inside glass panel. The intermediate trim adapter is preferably an extrusion of aluminum or vinyl and can snap fit into slots or grooves that receive legs of the intermediate trim adapter. The internal frame preferably has a variety of slots or grooves formed on it to receive the various trim adapters.

A user can use different trim adapters depending upon the thickness and configuration of the glass panels. The thin glass inside trim adapter 61 generally has thin glass inside trim adapter legs 79. The thin glass inside trim adapter legs 79 are generally parallel and form a spring between them so that a resilient bias occurs when a user selects the thin glass inside trim adapter 61, cuts it to length and snap fit presses the extrusion into the inside trim adapter receiving slot 53. The inside trim adapter receiving slot 53 has a pair of corners, each receiving one of the two thin glass inside trim adapter legs 79. The inside trim adapter has an inside trim adapter primary section 68 and an inside trim adapter secondary section 69. As seen in FIG. 1, the inside trim adapter primary section 68 can be formed as a first leg edge that engages a first corner groove of the inside trim adapter receiving slot 53. The inside trim adapter secondary section 6 to nine can also be formed as a second leg edge that engages a second corner groove of the inside trim adapter receiving slot 53. Alternatively, as seen in FIG. 2, the inside trim adapter primary section 68 can be formed as an inside trim adapter vertical section from which an inside trim adapter secondary section 69 extends as an inside trim adapter horizontal section. Preferably, a satisfying click is heard when snapping in the trim adapters.

During installation, the outside glass panel is typically installed first, followed by optionally an intermediate trim adapter, followed by an inside glass panel. The intermediate trim adapter 62 fits between the outside glass panel and the inside glass panel. The intermediate trim adapter can be formed as a spring that fits into intermediate trim adapter receiving grooves 54 that are formed on opposite sides of the thermal break extrusion means. The intermediate trim adapter 62 bridges across the thermal break extrusion members. The intermediate trim adapter can be of different shapes, and can be configured to be installed in reverse to provide different dimensions for holding glass panels. The intermediate trim adapter 62 preferably includes an intermediate trim adapter first leg 76 and an intermediate trim adapter second leg 78. The intermediate trim adapter first leg may have an intermediate trim adapter first leg horizontal section 77 extending substantially orthogonally from the intermediate trim adapter first leg 76. The intermediate trim adapter first leg 76 and the intermediate trim adapter second leg 78 form the spring that allows snap in interference fit installation of the intermediate trim adapter 62. The intermediate trim adapter 62 also has an intermediate trim adapter outside protrusion 71 and an intermediate trim adapter inside protrusion 72. The intermediate trim adapter outside protrusion 71 engages an outside intermediate trim adapter receiving groove 54 and the intermediate trim adapter inside protrusion 72 engages an inside intermediate trim adapter receiving groove 54. The outside intermediate trim adapter receiving groove 54 is extruded on the internal frame outer structure 40, and the inside trim adapter receiving groove 54 is extruded on the internal frame inner structure 50.

The intermediate trim adapter 62 also has an intermediate inside glazing bead 66 engaging the inside glass panel, and an intermediate outside glazing bead 67 engaging the outside glass panel. The inside glass panel can be single or double or laminate glass and the outside glass panel can be a single, double or laminate glass. The intermediate trim adapter 62 can be selected in a variety of different dimensions so that a variety of different glass panel thicknesses can be accommodated. The intermediate trim adapter preferably has an intermediate trim adapter outside protrusion 71 having a pointed edge and an intermediate trim adapter inside protrusion 72 also having a pointed edge.

The glass panel assembly has a variety of different acceptable structures such as a single flat pane of glass being the outside glass panel, or a laminate glass panel being the outside glass panel. Alternatively, an insulated structure can be selected as the outside glass panel with the first outside glass panel 81 which can be an outside glass panel of an insulated glass panel when combined with a second outside glass panel 82 and joined at the air seal spacer 83. The argon filled gas 95 can be pumped or released into the insulated cavity between the first outside glass panel 81 and the second outside glass panel 82. The air seal spacer 83 can be hollow and of rectangular cross-section tubular shape having an air seal spacer channel 84. The air seal spacer 83 can be formed of a metal sheet that is rolled into a spacer. The air seal spacer 83 is preferably sealed with an elastomeric sealant that provides good thermal expansion and contraction properties to avoid intrusion of moisture. The air seal spacer channel 84 may have desiccant installed within to absorb moisture. The thermal break extrusion means 90 is located between the outside and inside glass panels.

The glass panel assembly may further include a first inside glass panel 85 and a second inside glass panel 86 that is laminated at an inside polymer laminate layer 87. Alternatively, the inside glass can be selected to be of greater or less thickness in a configuration that has a second outside glass paneled polymer laminate layer 88 that is laminated to a second outside glass panel laminate pane 89. The inside glass panel can be joined to the outside glass panel by the air seal spacer 83 as seen in FIG. 1, or the inside glass panel can be made as a separate panel as seen in FIGS. 2 and 3. The key feature of the invention is the flexibility of selecting different glass panels. A user may switch the glass panels whenever the user wants without having to change out the frame. For example, the user could install stained-glass as the inside glass panel and keep the outside glass panel as a standard insulated panel.

Optionally, the internal frame central flange 42 can be detachable when formed as an outside trim adapter 64 as seen in FIG. 3. The outside trim adapter 64 can be mounted in an outside trim adapter receiving groove 55. The outside trim adapter has a leg that has edges that engage the outside trim adapter receiving groove 55. More specifically, the leg edges may include an outside adapter outside protrusion 74 and an outside adapter inside protrusion 73. Making the internal frame central flange 42 detachable as an outside trim adapter 64 allows for greater customization by providing different dimensions and tolerances when adapting the glass panel to the frame.

The internal frame can have an internal frame inside channel 56, and internal frame middle channel 57, and an internal frame outside channel 58. Forming the frame as a series of channels provides rigidity. The internal frame may also have an internal frame lower slot 59 that allows mounting of different connectors, roller assemblies, air seal or insulation apparatus between the peripheral frame and the internal frame.

The invention claimed is:

1. An insulated window frame comprising:

a. an outside glass panel, wherein the outside glass panel is made of at least one glass pane;

b. an inside glass panel;

c. a frame having at least an internal frame, wherein the internal frame further comprises:

i. an inside trim adapter receiver formed on an inside surface of the internal frame;

ii. an intermediate trim adapter receiver formed on the inside surface of the internal frame;

iii. an internal frame central flange extending from the internal frame, wherein the internal frame central flange retains an edge of the outside glass panel; and d. an inside trim adapter configured to fit to the inside trim adapter receiver, wherein the insulated window frame is configured to be upgraded from a first mode to a second mode after attaching an intermediate trim adapter to the intermediate trim adapter receiver between the outside glass panel and the inside glass panel, wherein the intermediate trim adapter is not attached to the intermediate trim adapter receiver in the first mode, wherein the internal frame comprises an internal frame outer structure and an internal frame inner structure, wherein a thermal break is installed between the internal frame outer structure and the internal frame inner structure, wherein the intermediate trim adapter receiver is formed as a groove or slot, wherein the intermediate trim adapter has a pair of engagement edges that engage the intermediate trim adapter receiver, wherein the inside trim adapter receiver is formed as a groove or slot, wherein the inside trim adapter has a pair of engagement edges that engage the inside trim adapter receiver.

2. The insulated window frame of claim 1, wherein the outside glass panel is mounted between the intermediate trim adapter and the internal frame central flange, and wherein the inside glass panel is mounted between the intermediate trim adapter and the inside trim adapter.

3. The insulated window frame of claim 1, further comprising an outside trim adapter connected to an outside trim adapter receiver.

4. The insulated window frame of claim 1, wherein the outside glass panel is attached to the inside glass panel by an air seal spacer to form an insulated glass panel, wherein the intermediate trim adapter receiver remains empty and does not hold the intermediate trim adapter.

5. The insulated window frame of claim 1, wherein the internal frame central flange has a trim seal mounting slot, wherein a trim seal is mounted in the trim seal mounting slot.

6. The insulated window frame of claim 1, wherein the intermediate trim adapter has a pair of engagement edges that engage to the intermediate trim adapter receiver.

7. The insulated window frame of claim 1, wherein the inside trim adapter has a pair of engagement edges that engage to the inside trim adapter receiver.

8. The insulated window frame of claim 1, further comprising a screen frame mounted within a screen frame slot, wherein the screen frame slot is formed on the frame.

9. The insulated window frame of claim 1, wherein the frame further comprises a peripheral frame, wherein the internal frame fits within the peripheral frame, wherein the internal frame is attached to the peripheral frame.

10. The insulated window frame of claim 9, wherein the internal frame comprises an internal frame outer structure and an internal frame inner structure.

11. The insulated window frame of claim 9, wherein the outside glass panel is mounted between the intermediate trim adapter and the internal frame central flange, and wherein the inside glass panel is mounted between the intermediate trim adapter and an inside trim adapter.

12. The insulated window frame of claim 9, further comprising an outside trim adapter connected to an outside trim adapter receiver.

13. The insulated window frame of claim 9, wherein the outside glass panel is attached to the inside glass panel by an air seal spacer to form an insulated glass panel, wherein the intermediate trim adapter receiver remains empty and does not hold the intermediate trim adapter.

14. The insulated window frame of claim 9, wherein the internal frame central flange has a trim seal mounting slot, wherein a trim seal is mounted in the trim seal mounting slot.

15. The insulated window frame of claim 9, wherein the intermediate trim adapter has a pair of engagement edges that engage to the intermediate trim adapter receiver.

16. The insulated window frame of claim 9, wherein the inside trim adapter has a pair of engagement edges that engage to the inside trim adapter receiver.

17. The insulated window frame of claim 9, further comprising a screen frame mounted within a screen frame slot, wherein the screen frame slot is formed on the peripheral frame.

18. The insulated window frame of claim 9, wherein the intermediate trim adapter receiver remains empty and does not hold the intermediate trim adapter; wherein the outside glass panel is mounted between the intermediate trim adapter and the internal frame central flange, and wherein the inside glass panel is mounted between the intermediate trim adapter and the inside trim adapter, further comprising an outside trim adapter connected to an outside trim adapter receiver, wherein the outside glass panel is attached to the inside glass panel by an air seal spacer to form an insulated glass panel.

* * * * *